United States Patent [19]

Ziegel

[11] 4,286,414

[45] Sep. 1, 1981

[54] WORK HOLDER

[75] Inventor: Douglas H. Ziegel, Indianapolis, Ind.

[73] Assignee: RCA Corporation, New York, N.Y.

[21] Appl. No.: 118,214

[22] Filed: Feb. 4, 1980

[51] Int. Cl.[3] ..... B24B 19/16

[52] U.S. Cl. ..... 51/229; 269/254 R; 279/41 R

[58] Field of Search ..... 51/229; 269/254 R; 279/41

[56] References Cited

U.S. PATENT DOCUMENTS

| | | | |
|---|---|---|---|
| 318,103 | 5/1885 | Gosling | 279/41 |
| 1,191,905 | 7/1916 | Maynard . | |
| 1,988,887 | 1/1935 | Armstrong . | |
| 2,274,520 | 2/1942 | Baumgold | 51/229 |
| 2,293,641 | 8/1942 | Dinhofer . | |
| 2,394,242 | 2/1946 | Jearum . | |
| 2,402,215 | 6/1946 | Thomas | 269/254 |
| 2,429,357 | 10/1947 | Jacoby . | |
| 2,449,423 | 9/1948 | Spira | 52/229 |
| 2,542,698 | 2/1951 | O'Brien | 51/229 |
| 2,579,666 | 12/1951 | Hans | 51/229 |
| 2,614,516 | 10/1952 | Soderman | 269/254 R |

*Primary Examiner*—Harold D. Whitehead

*Attorney, Agent, or Firm*—Birgit E. Morris; Donald S. Cohen

[57] ABSTRACT

A work holder includes an elongated, hollow, cylindrical handle and a head secured within one end of the handle. A fixed jaw is secured to the head and projects longitudinally from the end of the handle. The fixed jaw has a pointed tip on its free end. A movable jaw is over the fixed jaw and is pivotally seated on an annular flange on the head. The movable jaw has a pointed tip which contacts the tip of the fixed jaw. A spring extends around the two jaws. The spring normally holds the tips together but allows pivoting of the movable jaw to separate the tips and thereby allow insertion or removal of a workpiece.

8 Claims, 4 Drawing Figures

WORK HOLDER

BACKGROUND OF THE INVENTION

The present invention relates to a work holder and particularly to a pencil-like holder for holding diamonds as they are lapped.

In U.S. Pat. No. 4,162,510 issued to Eugene O. Keizer, on July 24, 1979 entitled "KEEL-TIPPED STYLUS FOR VIDEO DISC SYSTEMS", there is shown and described a stylus for an information record playback system such as a video disc. The stylus is a body of a dielectric material, preferably diamond, which is shaped to provide it with a keel tip suitable for insertion in a groove in the recorded disc. To make this stylus it is necessary to perform several lapping operations. When the stylus is made of diamond it is desirable to lap the diamond along specific crystallographic planes.

In view of the small size of the stylus body it is necessary to support the body in a work holder to carry out the lapping operations. The work holder should be capable of firmly holding the body during the lapping operations, but still provide for ease of insertion or removal of the body. Also it is desirable that the work holder permit adjustment of the position of the body to permit lapping the body along desired crystallographic planes.

SUMMARY OF THE INVENTION

A work holder includes a handle and a pair of jaws projecting from one end of the handle. The jaws are at an angle with respect to each other and have tips at one end which contact each other. The work holder includes means for normally holding the tips of the jaws together but permitting the movement of at least one of the jaws to separate the tips for the purpose of inserting or removing a workpiece.

DETAILED DESCRIPTION OF THE INVENTION

Figure 1:
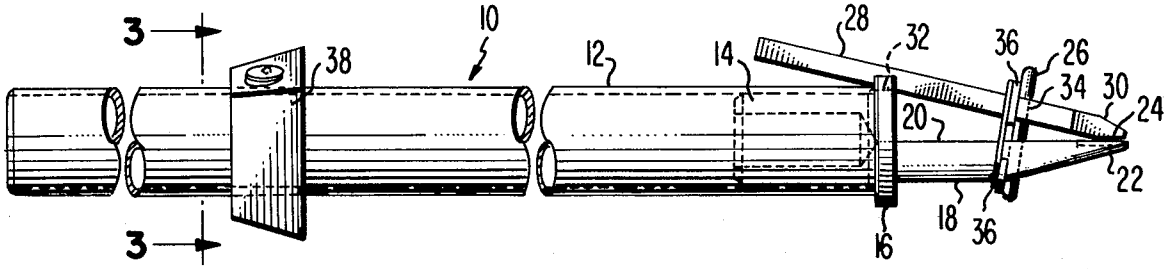
FIG. 1 is a side elevation view of a form of the work holder of the present invention.

Referring to FIG. 1 a form of the work holder of the present invention is generally designated as 10. The work holder 10 includes an elongated tubular handle 12 of a light weight metal such as aluminum. A cylindrical head 14 is secured within one end of the handle 12, such as by a press fit. The head 14 has an annular flange 16 therearound which projects radially beyond the outer surface of the handle 12. A fixed jaw 18 projects longitudinally from the head 14. The fixed jaw 18 has a flat surface 20 which extends along the longitudinal axis of the handle 12. The free end of the fixed jaw 18 is tapered to form a pointed tip 22. The flat surface 20 has a narrow groove 24 therein at the tip 22 in which a workpiece is adapted to be seated. A pin 26 extends through and is secured to the fixed jaw 18. The pin 26 projects from the flat surface 20 at a slight angle away from the handle 12.

A movable jaw 28 extends over the fixed jaw 18. The movable jaw 28 is substantially rectangular and is tapered at one end to provide a pointed tip 30. The tip 30 of the movable jaw 28 is seated on the tip 22 of the fixed jaw 18 and the movable jaw 28 extends at an angle with respect to the fixed jaw 18. The other end of the movable jaw 28 extends through and is seated in a notch 32 in the flange 16. The movable jaw 28 has an opening 34 therethrough through which the pin 26 projects.

A pair of spring members 36 extend around the jaws 18 and 28 directly behind the pin 26. As shown the spring members 36 are each a c-clip extending around the jaws 18 and 28 from opposite directions. The spring members 36 are of a size that normally hold the tips 22 and 30 together but when the end of the movable jaw 28 and the handle 12 are pressed together will expand slightly to separate the tips 22 and 30. Thus, the tips 22 and 30 can be separated to permit insertion or removal of a workpiece but are normally held together to firmly secure the workpiece between the tips.

Figure 3:
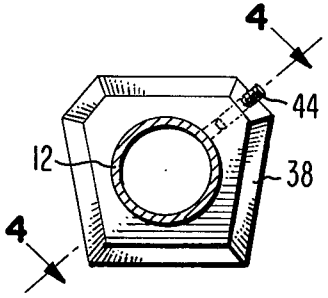
FIG. 3 is a sectional view taken along line 3—3 of FIG. 1.
Figure 4:
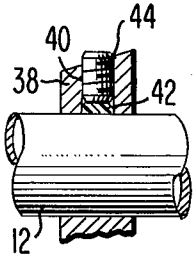
FIG. 4 is a sectional view taken along line 4—4 of FIG. 3.
Figure 2:
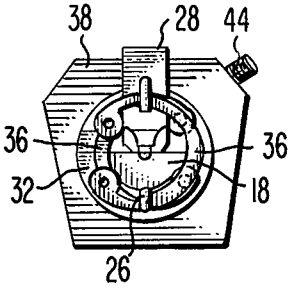
FIG. 2 is a front elevational view of the work holder.

A positioning ring 38 surrounds the handle 12. As shown in FIG. 3, the positioning ring 38 is the shape of a keystone. The positioning ring 38 has a hole 40 extending radially therethrough from an outer surface to its inner surface. A plastic ball 42, preferably of nylon, is within the hole 40 as shown in FIG. 4. A set screw is threaded in the hole 40 and presses the plastic ball 42 against the surface of the handle 12 and extrudes the ball into the threads in the hole 40. The pressure of the plastic ball 42 against the handle 12 is sufficient to hold the positioning ring 38 in position on the handle 12 but will still allow rotation of the handle within the positioning ring 38. Thus, by inserting the positioning ring 38 in a suitable fixture and rotating the handle 12 with respect to the positioning ring 38, a surface of a workpiece being held between the tips 22 and 30 can be positioned with respect to the positioning ring 38. Since the ball 42 is made of a plastic, rotation of the handle 12 with respect to the positioning ring 38 will not scratch or otherwise damage the handle 12. Also, since the ball 42 is extruded into the threads of the hole 40, the ball 42 will not be lost if the positioning ring 38 is removed from the handle 12.

Although the specific dimensions of the work holder 10 are not critical, typical dimensions for a work holder for use in lapping small diamond workpieces are as follows: length of handle—about $4\frac{1}{2}$ inches ($11\frac{1}{2}$ cm); diameter of handle—about $\frac{1}{4}$ inch (0.6 cm); length of fixed jaw about $1\frac{5}{8}$ inch (4 cm); length of movable jaw about 1 inch ($2\frac{1}{2}$ cm).

I claim:

1. A work holder, comprising:

a handle;

a fixed jaw secured to one end of the handle and projecting therefrom, the fixed jaw having a flat surface extending longitudinally from the end of the handle and the fixed jaw being tapered at one end to provide a pointed tip;

a movable jaw pivotally mounted over the fixed jaw and having a pointed tip at one end which contacts the pointed tip of the fixed jaw, the movable jaw being at an angle with respect to the fixed jaw;

a pin extending through both of said jaws, the pin being fixedly secured to the fixed jaw and the movable jaw being movable along said pin; and means normally holding said tips of said jaws together while permitting movement of the movable jaw to separate said tips of said jaws to permit a workpiece to be inserted between said tips of said jaws and to permit a workpiece to be removed from between said tips of said jaws.

2. A work holder in accordance with claim 1 including an annular flange at one end of the handle extending radially outwardly beyond the outer surface of the handle, the fixed jaw extending longitudinally from said flange and the movable jaw extending through a notch in the edge of the flange so that the movable jaw will pivot on the flange.

3. A work holder in accordance with claim 2 in which the means holding the tips of the jaws together is a spring means extending around the jaws adjacent the pin.

4. A work holder in accordance with claim 3 in which the pin projects beyond each of the jaws and the spring means is a pair of c-clips extending around the jaws from opposite directions and seated against the projecting ends of the pin.

5. A work holder in accordance with claim 1 including a positioning ring around the handle, said positioning ring having a relatively tight fit on the handle part and being rotatable about the handle.

6. A work holder in accordance with claim 5 in which the positioning ring has an opening therethrough to the handle, a plastic ball is in the opening and a set screw is threaded in the opening and presses the ball against the handle to provide the tight fit with the handle.

7. A work holder comprising an elongated hollow cylindrical handle, a head fitting tightly within one end of the handle, said head having an annular flange extending radially outwardly along said one end of the handle beyond the outer surface of the handle, said flange having a notch in its edge, a fixed jaw secured to said head and projecting longitudinally from said one end of the handle, said fixed jaw having a pointed tip at its free end, a movable jaw extending along said fixed jaw and extending through and seated in the notch in the flange, the movable jaw having a pointed tip at one end which contacts the tip of the fixed jaw, a pin extending through and projecting beyond said jaws, said pin being secured to the fixed jaw and the movable jaw being movable along said pin, and spring means extending around said jaws adjacent said pin, said spring means normally holding the tips of the jaws together but permitting pivotal movement of the movable jaw so as to separate the tips to permit insertion and removal of a workpiece.

8. A work holder in accordance with claim 7 including a positioning ring around said handle, said positioning ring having a relatively tight fit with said handle but being capable of being rotated about said handle.

* * * * *